United States Patent [19]

Agrawal et al.

[11] Patent Number: 4,814,025

[45] Date of Patent: Mar. 21, 1989

[54] METHOD OF IMPROVING PROPERTIES OF SUPERPLASTICALLY FORMED ALLOYS BY HEALING CAVITIES

[75] Inventors: Suphal P. Agrawal, Rancho Palos Verdes; Gregory V. Scarich, Hermosa Beach, both of Calif.

[73] Assignee: Northrop Corporation, Hawthorne, Calif.

[21] Appl. No.: 152,120

[22] Filed: Feb. 4, 1988

Related U.S. Application Data

[63] Continuation of Ser. No. 892,008, Jul. 29, 1986, abandoned.

[51] Int. Cl.[4] ..... C21D 7/13

[52] U.S. Cl. ..... 148/11.5 A; 148/1; 148/131; 148/437; 420/528; 420/540; 420/902

[58] Field of Search ..... 148/1, 4, 11.5 A, 131, 148/437; 420/528, 540, 902

[56] References Cited

U.S. PATENT DOCUMENTS

| | | | |
|---|---|---|---|
| 3,496,624 | 2/1970 | Karr et al. | 148/4 |
| 4,233,831 | 11/1980 | Hamilton et al. | 72/60 |
| 4,354,369 | 10/1982 | Hamilton | 72/38 |
| 4,615,745 | 10/1986 | Göransson et al. | 148/4 |

OTHER PUBLICATIONS

*Industrial Heating*, "Hot Isostatic Pressing–a New Heat Treating Technology with Tremendous Potential", Price, P., Jun. 1979, pp. 8–10.

*Primary Examiner*—L. Dewyane Rutledge
*Assistant Examiner*—George Wyszomierski
*Attorney, Agent, or Firm*—Terry J. Anderson; Robert B. Block

[57] ABSTRACT

A method for improving mechanical properties of superplastically formed alloy by healing the cavities formed as result of a superplastic forming process is disclosed. The alloy, such as an aluminum alloy, is superplastically formed and is then placed in an autoclave and hot isostatically pressed at a pressure ranging from about 10,000 psi to 30,000 psi for a time and temperature sufficient to heal cavities.

3 Claims, 2 Drawing Sheets

METHOD OF IMPROVING PROPERTIES OF SUPERPLASTICALLY FORMED ALLOYS BY HEALING CAVITIES

BACKGROUND OF THE INVENTION

1. Field of the Invention

This invention relates generally to the concepts of forming metallic materials and improving the properties of these materials, and more particularly to an improved method of improving the properties of superplastically formed metallic materials, such as aluminum alloys, by healing the cavities that are formed in the structure of these materials as a result of a superplastic forming technique.

2. Description of the Prior Art

Superplastic forming is one of the most important metal forming technologies to emerge in recent years. This technology uses a phenomenon called superplasticity which occurs in several metals under certain conditions of microstructure, temperature, and strain rate. The most important characteristic of superplastically formable materials is their exceptional stability in uniaxial tensile deformation. This enables them to develop extremely large elongations, usually greater than 200 percent, without fracture; whereas, for conventional materials the equivalent values are usually less than 50 percent. Since the potential for large elongations in several structural metals, such as titanium and aluminum alloys, was first demonstrated, the superplastic forming of such alloys has been systematically developed into a technology for manufacturing parts on a production basis.

There are many methods described in the prior art that employ the principle of superplastic metal forming. However, many of these superplastic forming techniques result in the disadvantage of forming internal voids or cavities at the grain boundary area of the materila, i.e. "cavitation", which generally results in poorer mechanical properties in the metal part so formed.

U.S. Pat. No. 4,288,021 describes tooling for use in an autoclave or a hot press for the superplastic forming and diffusion bonding of metals. An autoclave is used to contain the metal component prior to superplastic forming as well as the entire tooling for the forming procedure. The primary objectives are to provide a method of superplastic forming by employing an effective high-temperature/gas-pressure sealing method and an inert atmosphere for forming. In the described method, the gas is controllably leaked so that the forming part only experiences relatively low pressures (estimated to be about 200 psig from the description), i.e., only the magnitude of pressure necessary for superplastically forming the metal component into a part. While this magnitude of pressure may be sufficient to form the metal component into a part with a specific geometrical shape, it is not sufficient to prevent the formation of cavities in structural high-strength alloys (such as many of the structural aluminum alloys). Furthermore, once the cavities are formed within the material, even higher pressures than those necessary for prevention of cavity nucleation (or generation) will be required for cavity closure. This is a typical example of the type of superplastic forming process that can lead to the problem of cavitation.

U.S. Pat. No. 4,354,369 describes a method for superplastic forming which according to the disclosure eliminates internal voids. In the first described embodiment a blank of material which is capable of being formed superplastically is held opposite a forming surface of a die. The blank is then heated to the superplastic forming temperature and a pressure is applied to both sides of the blank. The pressure is sufficient to prevent the formation of voids. Thus, the primary objective of the method of this patent is to prevent internal voids from occurring during superplastic forming. Should the proposed method not succeed, the patent also has a secondary objective to remove already formed voids by plastic deformation and diffusion. It teaches the use of forming gas pressure to force the formed part against the tool surface to remove voids. Based upon the current industrial pratices of superplastic forming, the peak magnitudes of gas pressure are in the range of about 100 to 500 psig. Currently used tooling is not capable of safe application at pressures much beyond this range. While these pressures are adequate to suppress, even prevent, cavitation during forming, they are grossly inadequate to heal already formed cavities, and thus not a solution to the problem of residual cavitation in the material after forming.

SUMMARY OF THE INVENTION

It is a specific goal of the present invention to heal or remove cavities that exist in a metallic part as a result of superplastic forming process by subjecting the metal part at elevated temperatures to sufficiently high pressures to heal the cavities thereby reducing the chances of an unacceptable deterioration of the component properties which may be expected due to the presence of cavities.

When certain metallic alloys, particularly some of the structural aluminum alloys, are superplastically formed, cavitation is observed during such deformation. Cavitation is a phenomenon which generally arises under the combined action of tensile stress and grain boundary sliding of the grains in the material. Both of these conditions exist during the superplastic forming process. In its simplest form, when one grain slides past other grain(s) during the forming process, a cavity may be generated along the boundary therebetween, unless an accommodation event occurs forcing the same or another grain, or a part thereof, to close the cavity. Although triple-grain junctions or triple points are the usual sites for cavities, such cavities may also be observed at other locations on the grain boundaries in superplastically deformed material.

Cavitation places a limitation on the final properties of components formed by the superplastic forming process. Elimination or a substantial reduction of cavities is essential to enhance these properties and to ensure that the desirable properties will be available in the product formed by the superplastic forming process.

It is therefore an object of the present invention to provide a heat treatment for alloys, particularly aluminum alloys, that is devoid of substantially all of the above-noted disadvantages.

Another object of the present invention is to provide a heat treatment for aluminum alloys that will improve the mechanical properties of these alloys, particularly the 7000 series aluminum alloys.

Still another object of the present invention is to provide a heat treatment for aluminum alloys in combination with high pressures that will heal cavities formed in these alloys as a result of a superplastic forming process.

The foregoing objects and others are accomplished in accordance with the present invention by providing a method for improving the mechanical properties of an alloy product by healing cavities formed in the alloy during a superplastic forming process comprising hot isostatically pressing the superplastically formed alloy product with an inert gas, such as argon, at a pressure of about 10,000 psi to about 30,000 psi at a temperature and for a time sufficient to heal the cavities.

BRIEF DESCRIPTION OF THE DRAWINGS

Other features and advantages of the present invention will become apparent from the following description taken in conjunction with the accompanying drawings wherein.

DESCRIPTION OF THE PREFERRED EMBODIMENTS

Aluminum alloys which are superplastically formed generally show evidence of the formation of cavities near grain boundaries and the triple-point junction of grains. Such cavitation appears to be due largely to the combined result of tensile stress and grain-boundary sliding, both of which exist during superplastic elongation of metals. The mechanism of cavity nucleation is described above, and a method specifically employed to alleviate such cavity nucleation and growth during the superplastic forming process by the use of a compressive stress applied in a certain manner during the superplastic forming process itself is described in commonly assigned U.S. Pat. No. 4,516,419 issued on May 14, 1985 and titled "Methods of Enhancing Superplastic Formability of Aluminum Alloys by Alleviating Cavitation."

One of the primary problems associated with cavity formation in alloys is the negative effect that these cavities have on structural properties, i.e., the cavities are most likely to reduce some structural properties such as fatigue properties. This is clearly illustrated in FIG. 1 (described in detail hereinbelow) with regard to alloys that exhibit cavity formation after being processed by a superplastic forming process. In accordance with the features of the present invention, these cavities can be healed after the superplastic forming process. Basically, in accordance with the features of the present invention, the desired superplastic forming process is selected and performed in a conventional manner on the metal component. Thereafter, the superplastically formed metal component is placed in an autoclave and hot isostatically pressed, with an inert gas, such as argon, at the critical pressures preferably ranging from about 10,000 psi to about 30,000 psi to heal the cavities. In accordance with the further preferred features of the present invention the parts are heated at a temperature ranging from about 850° F. to about 1000° F., depending upon the specific alloy, for a time period, ranging from about 1 hour to about 8 hours, again depending upon the specific alloy, while in the autoclave at the elevated pressures.

Figure 1:
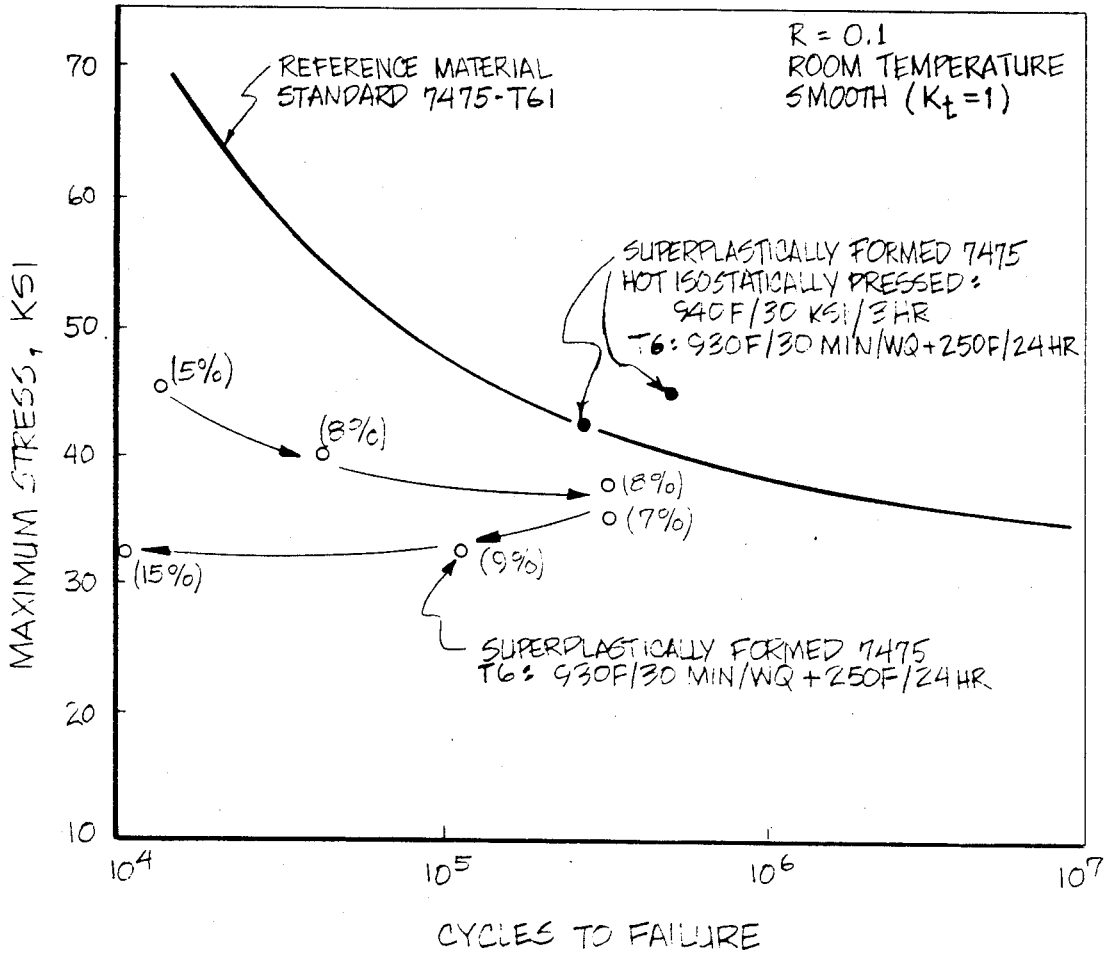
FIG. 1 is a graph that illustrates and compares a reference material (7475 aluminum alloy) with the effect of cavities on the fatigue properties of superplastically formed 7475 aluminum alloy and the effect on fatigue properties of the same alloy employing the method in accordance with the present invention to remove such cavities (NOTE: Percent numbers in parentheses represent percent cavitation by area in each sample tested. Arrows indicate degradation in fatigue behavior—drop in maximum stress or reduction in fatigue life—with increase in cavitation amount.)

The deleterious effect of cavities produced during a superplastic forming process on fatigue properties of alloys, and the restoration of these properties to normal values upon cavity healing by subjecting a superplastically produced alloy part to the method in accordance with the present invention is illustrated in the graph shown in FIG. 1. The graph illustrates (i) the fatigue properties of a 7475 aluminum alloy reference material that has been subjected to a T6 heat treatment, i.e., heated at 930° F. for 30 minutes, water quenched and then heated at 250° F. for 24 hours (top curve) and (ii) the lower fatigue strengths of 7475 aluminum alloy parts that were superplastically formed and the T6 heat treated by heating the parts at 930° F. for 30 minutes followed by quenching in water and a second heating at 250° F. for 24 hours (lower curve with arrows). The percent (%) numbers in parentheses represent percent cavitation by area in each sample tested. The arrows indicate degradation in fatigue behavior (drop in maximum stress or reduction in fatigue life) with increase in cavitation amount. The graph in FIG. 1 also illustrates the improved fatigue strength by removing the cavitation in accordance with the process of the present invention and employs standard 7475 aluminum alloy as a basis for comparison. Aluminum alloy 7475 parts were superplastically formed in the same manner as the above parts and then placed in an autoclave and isostatically pressed at 30,000 psi at 940° F. for 3 hours. These parts were then T6 heat treated. The fatigue properties of material prepared in accordance with the present invention are shown by the two dark dots on the top curve of FIG. 1. The superplastically formed alloy parts (in an appropriate tempered condition) with cavities clearly have lower fatigue lives than the standard 7475 aluminum alloy sheet (in equivalent temper) without cavities. These test results indicate a clear relationship between the amount of cavitation and fatigue behavior. The specimens with the larger area of cavities exhibited a much shorter fatigue life as well as a lower maximum stress for the same life than the other specimens with less cavitation. However, the fatigue behavior of the superplastically formed aluminum alloy samples that were then subject to being hot isostatically pressed in accordance with the critical parameters of the present invention (in identical heat treated condition) was significantly better than the samples that were only superplastically formed and tested. Indeed, the superplastically formed samples subjected to the process of the present invention were equivalent to the behavior of the standard 7475 aluminum alloy sheet.

Figure 2:
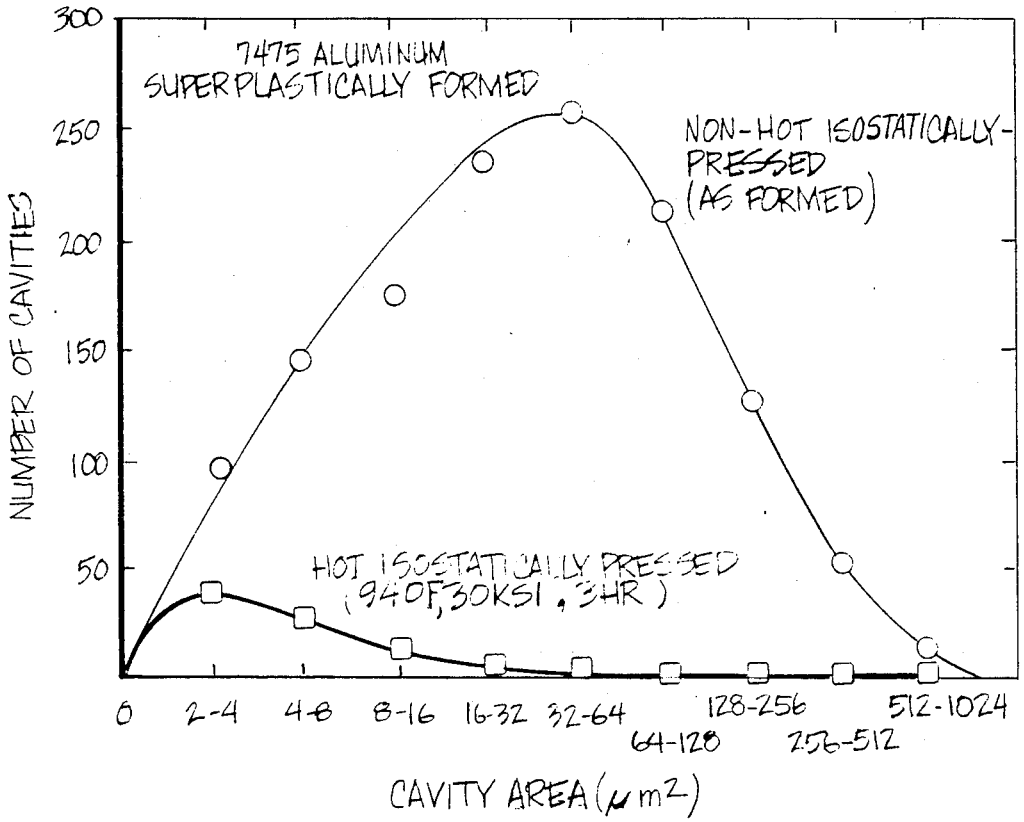
FIG. 2 is a graph that illustrates and compares the number of cavities versus cavity size in a superplastically formed 7475 aluminum alloy and in the same alloy after it had been subjected to the method in accordance with the present invention to remove such cavities.

The effectiveness of the process in accordance with the present invention was verified by first superplastically forming a sample to a large enough strain to result in appreciable cavitation (up to 15% by area). One section was then metallographically examined as formed whereas the other was hot isostaticaly pressed at 940° F. temperature, 30 ksi pressure for 3 hours before metallographic examination. A cavit histogram (number of cavities versus size distribution curve) for the as superplastically-processed after hot isostatically pressed sections is shown in FIG. 2. The near-extinction of cavities by employing the method of the present invention is apparent in FIG. 2. These resutls unambiguously show that not only are the cavities drastically reduced in number (as shown by an approximately seven-fold reduction in peak), but their maximum size has also diminished (as shown by an approximately sixteen-fold reduction in cavity area). FIG. 2 shows histograms of cavity sizes vs. number of cavities of a given size, for the superplastically formed produce (as formed) and after it is hot isostatically pressed in accordance with this invention as shown, the product is substantially free of cavities of a size greater than about 16–32 micrometers squared.

The method in accordance with the present invention provides a unique way of alleviating whatever cavities may exist in superplastically formed alloys, particularly aluminum alloys, thereby improving properties in the superplastically processed material to magnitudes comparable to those that exist before superplastic forming.

While this invention has been described in conjunction with specific embodiments thereof, it is evident that many alternatives, modifications and variations will be apparent to those skilled in the art. Accordingly, the present invention is intended to embrace all such alternatives, modifications and variations, that fall within the spirit and scope of the appended claims.

What is claimed is:

1. In a method of superplastically forming a sheet of aluminum product from a worked alloy sheet made of an aluminum alloy exhibiting superplasticity, the steps of superplastically forming the worked aluminum alloy sheet into a product, said product having small cavities located within its structure as a result of the superplastic forming process and thereafter hot isostatically pressing the superplastically formed product in an autoclave or hot isostatic pressing unit (HIP) with an inert gas at a pressure of from about 10,000 psi to about 30,000 psi at a temperature of 850° F. to 1000° F. for a time of from 1–8 hours to heal the cavities and render the product substantially free of cavities of a size greater than about 16–32 micrometers squared.

2. A method according to claim 1 wherein said aluminum alloy is any alloy selected from the 7000 series aluminum alloys.

3. An alloy product produced by the method of claim 1.

* * * * *